US005836123A

United States Patent [19]

Gulino

[11] Patent Number: 5,836,123

[45] Date of Patent: Nov. 17, 1998

[54] VINYL-SIDING CORNER BLOCK

[76] Inventor: Francesco Gulino, 1714 Whitpain Hills, Blue Bell, Pa. 19422

[21] Appl. No.: 653,450

[22] Filed: May 24, 1996

[51] Int. Cl.[6] ..... E04F 13/00

[52] U.S. Cl. ..... 52/288.1; 52/314; 52/591.4

[58] Field of Search ..... 52/287.1, 288.1, 52/57, 555, 314, 591.4, 592.3

[56] References Cited

U.S. PATENT DOCUMENTS

| | | | |
|---|---|---|---|
| D. 322,858 | 12/1991 | Dean . | |
| 1,959,133 | 5/1934 | Klimsza . | |
| 2,005,462 | 6/1935 | Gibson | 52/555 |
| 2,114,044 | 4/1938 | Bonnell | 52/288.1 |
| 2,245,047 | 6/1941 | Odell . | |
| 2,255,736 | 9/1941 | Odell . | |
| 2,305,280 | 12/1942 | Strunk et al. . | |
| 3,452,499 | 7/1969 | Ciullo . | |
| 3,488,908 | 1/1970 | Jahn | 52/591.4 |
| 3,496,694 | 2/1970 | Hicks et al. . | |
| 3,621,625 | 11/1971 | Medow . | |
| 3,651,610 | 3/1972 | Donahue | 52/288.1 |
| 3,654,053 | 4/1972 | Toedter . | |
| 3,731,441 | 5/1973 | Dixon | 52/591.4 |
| 3,991,529 | 11/1976 | Terwilliger . | |
| 4,401,705 | 8/1983 | Ewert . | |
| 4,920,709 | 5/1990 | Garries et al. . | |
| 5,086,598 | 2/1992 | Weldy | 52/288.1 |
| 5,167,103 | 12/1992 | Lindal et al. . | |
| 5,173,337 | 12/1992 | Nelson . | |
| 5,542,222 | 8/1996 | Wilson et al. | 52/288.1 |
| 5,544,463 | 8/1996 | Bergin | 52/288.1 |

FOREIGN PATENT DOCUMENTS

| | | | |
|---|---|---|---|
| 585749 | 12/1947 | United Kingdom | 52/591.1 |

OTHER PUBLICATIONS

Alside Catalogue (2 sheets); Dec. 1993.

CertainTeed Catalogue (2 sheets); Nov. 1994.

*Primary Examiner*—Michael Safavi

*Attorney, Agent, or Firm*—Elman & Associates

[57] ABSTRACT

A prefabricated vinyl-siding corner block is provided for use as a corner on a building. The vinyl-siding corner blocks have raised portions that are formed to resemble structural building materials such as brickwork, stone, wood, stucco, or other materials used for surface elements of buildings and recessed portions formed to resemble a stone surfaces of a course of mortar or cement. The vinyl-siding corner block is preferably formed to have the appearance of stone blocks with a quarried, sawn or sculptured appearance. The vinyl-siding corner block is formed to facilitate interaction with readily available conventional siding materials and may be readily attached to the frame of a building with the minimum of tools and labor and thus contributes to the achievement of a relatively low construction cost.

6 Claims, 6 Drawing Sheets

VINYL-SIDING CORNER BLOCK

BACKGROUND OF THE INVENTION

The invention disclosed herein relates to the construction of houses and the like. It provides corner elements for use in connection with conventional siding of plastic composition that are applied to the walls of building structures.

Methods and materials to yield a desirable appearance are common in the art of building construction. Indeed, the provision of a desirable appearance is a principal goal of both architects and builders. The art in the field of building construction discloses various methods of providing a desirable appearance to a finished building, especially by the simulation of a natural stone appearance. A material that provides the appearance of a natural or manmade solid medium is frequently more practical and less expensive than the solid material that its appearance simulates.

SUMMARY OF THE INVENTION

The invention comprises vinyl-siding corner blocks shaped to fit together at the corner of a building. The vinyl-corner blocks disclosed herein provide a surface that gives the appearance of solid building materials such as stone blocks. The vinyl-siding corner blocks of this invention also provide means to interact with and cover the ends of adjacent siding sections which meet at corners of the building structure to which the vinyl-siding corner blocks of the invention are applied.

It is an object of the present invention to provide a novel construction material that provides a desirable appearance when applied to the corners of buildings.

It is another object of the present invention to provide a construction material to be applied to the corners of buildings that simulates the appearance of solid stone blocks with a quarried or sculptured appearance.

It is still another object of the present invention to provide a building material to be applied to the corners of buildings that simulates the appearance of a stacked series of solid stone blocks with a quarried, sawn or sculptured appearance.

It is yet another object of the present invention to provide a building material to be applied to the corners of buildings that simulates the appearance of structural building materials such as brickwork, stone, wood, stucco or other materials used for surface elements of buildings.

It is a further object of the present invention to provide a building material to be applied to the corners of buildings which has recessed portions that simulate the appearance of a recessed area of stone or a course of mortar or cement.

These as well as other objects are accomplished by providing a construction material comprising a vinyl-siding corner block for application to the corners of buildings during the building or renovation of houses and the like.

The disclosed vinyl-siding corner block is formed as a sheet of integrally molded plastic material that forms an angled element with two portions or wings that are set at an angle to one another. Preferably the plastic material is polyvinyl chloride. The angle at which the wings are set is preferably a right-angle. The wings of the angled element each have an exterior surface and an interior surface, and each exterior surface is formed to have raised portions and recessed portions thereon. The wings of the angled element are formed with a groove in the upper edge and along the two side, or distal, edges. The wings of the angled element are also formed with a ridge along the lower edge. Typically, the ridge is formed to slidably fit into the groove without the application of undue force or effort. Preferably the groove is formed to be about one-half inch in depth and five-eighths inch wide. Other dimensions suitable for the groove and the ridge will be readily apparent to those of skill in the art.

Another embodiment of the vinyl-siding corner block disclosed herein is for application to a brick-faced building. In this embodiment the vinyl-siding corner block comprises a sheet of molded material disposed as a single planar sheet or wing. The wing of this embodiment is formed to have an exterior surface, an interior surface, an upper edge, a lower edge, a proximal edge and a distal edge. The exterior surface has a raised portion and a recessed portion thereon.

The upper edge and the distal edge of the planar vinyl-siding corner block are formed to have a groove therein that is continuous around the upper edge and the distal edge. The lower edge of the block is formed with a ridge thereon. The proximal edge of the wing is formed to be flat. The planar vinyl-siding corner block embodiment of the invention is designed to be used in conjunction with a conventional J-channel. To facilitate use of the planar vinyl-siding corner block embodiment in conjunction with a conventional J-channel the planar block is formed with a vertical tongue on the upper edge, adjacent to the proximal edge. The vertical tongue may have any suitable size and be in any suitable position. Preferably the vertical tongue is formed three-quarters of an inch from the proximal edge and is one-and-a-half inch in width.

In order to permit attachment of the vinyl-siding corner block to buildings, the distal edges, or sides, of the vinyl-siding corner blocks are formed with a flange and a tongue through which attachment means may be passed. Certain embodiments of the vinyl-siding corner block have an L-shaped flange formed upon their upper edges and located at the junction of the two wings to provide an additional site for attachment means. Still other embodiments have a vertical tongue formed upon their upper edge for placement of attachment means that controls undesirable movement of the block after attachment to the building.

Preferably the interior surface of the flange, tongue and vertical tongue, is co-planar with the interior surface of the vinyl-siding corner block. Preferably the tongue extends from the distal edge sufficiently so as to permit attachment of the angled element to structural elements of a building, such as studs and the like. Most preferably the tongue is made to have an interior surface that is co-planar with the interior surface of the angled element, and the tongue extends more than 16 inches to permit attachment of the vinyl-siding corner block to studs placed at conventional 16-inch spacing. Typically the flange and the tongue of the angled element are provided with perforations through which fixing means such as nails or screws are passed, when fixing the vinyl-siding corner blocks of the invention to a building. Preferably the perforations in the flanges, vertical tongues and the tongues of the angled elements are slotted perforations so that when fixing means such as nails are passed through the slots, and not cleated tight, vinyl-siding corner blocks of the invention affixed to a building can expand and contract, in a warming and cooling environment, without warping, bending, distorting or cracking. Most preferably the perforations in the flanges, vertical tongues and the tongues of the angled elements are slotted perforations about one-half inch long and about one-eighth inch wide.

Vinyl-siding corner blocks of the type disclosed herein may be formed in a variety of sizes. Sizes envisaged, include blocks with raised portions from eight inches square to fourteen inches square. Preferably, blocks will have raised portions about twelve inches square. Other suitable sizes will be apparent to those of skill in the building art such that the blocks have a size that is proportional to the size of the building to which they are applied. The recessed portions of the vinyl-siding corner blocks of the type disclosed herein may also be formed in a variety of sizes. Preferably the vertical dimension of the recessed portion of the block is about twenty percent of the vertical dimension of the raised portion of the block. Suitable dimensions for the recessed portion of a vinyl-siding corner block to provide an attractive appearance to a building to which the blocks are applied will be apparent to architects and to those of skill in the building art.

Embodiments of the invention that comprise blocks of smaller size are anticipated to be made with wider or longer tongues, flanges and vertical tongues in order that these elements extend sufficiently so as to permit attachment of the vinyl-siding corner block to studs placed at a conventional 16-inch spacing.

Multiple vinyl-siding corner blocks of the type disclosed herein may be applied to a building. A first block is positioned at the bottom-most position of a corner of a building and attached to the building by its tongues and flanges. A second vinyl-siding corner block is then positioned above the first, with the ridge of the lower edge of the angled element of the second vinyl-siding corner block interactively positioned with the groove of the upper edge of the angled element of the first vinyl-siding corner block. The second vinyl-siding corner block is then attached to the building by its tongues and flanges. A third, and subsequent, vinyl-siding corner block is then applied in a similar manner. The grooves provided in the sides, or distal edges, of the vinyl-siding corner blocks have dimensions that permit conventional siding to be slid into the groove. This feature of the invention provides that conventional siding applied to the building can be interactively positioned in the grooves in the sides, or distal edges, of the angled elements. Conventional siding interactively positioned in the grooves of the vinyl-siding corner blocks, is thereby affixed to a building in a way that it can expand and contract, in a warming and cooling environment, without warping, bending, distorting or cracking.

The invention further provides means for securely anchoring the vinyl-siding corner blocks to the structure of a building to which the blocks are applied. These means have the form of tongues that serve, when affixed to the structure, to hold the corner members tightly against the outer surfaces of the underlying structural elements of the building.

The vinyl-siding corner blocks disclosed herein are especially adapted for use in connection with vinyl siding. The grooved upper edge of a vinyl-siding corner block may also be used to advantage in connection with the application of siding sections to a building having an A-frame style roof. In such a use, the siding section used to fill the "A" portion of the side wall of the building may be cut to slide into, and fit within, the groove in the upper edge of the vinyl-siding corner block. When used at the corners of a building having a Mansard style roof, the vinyl-siding corner blocks are applied to abut to the sofit board.

In an embodiment of the vinyl-siding corner block disclosed herein, the sheet of molded material is disposed as two faces, or wings, set substantially at right angles to one another, and the raised portions are formed to resemble structural building materials such as brickwork, stone, wood, stucco or other materials used for surface elements of buildings. In this embodiment the recessed portions of the vinyl-siding corner block are formed to resemble a course of mortar or cement.

In another embodiment of the vinyl-siding corner block disclosed herein the two wings of the sheet of molded material are formed to resemble a stone or masonry block and the recessed portions are formed to resemble a recessed stone portion.

In a further embodiment of the vinyl-siding corner block disclosed herein, the faces are formed as a plurality of raised portions that resemble stone or masonry blocks with the recessed portions therebetween formed to resemble recessed stone surfaces, or courses of mortar or cement.

The vinyl-siding corner blocks of this invention may be fabricated by any of a number of techniques known to those skilled in the art of fabricating plastic materials and the like. Preferably, vinyl-siding corner blocks of the kind disclosed herein are formed by a casting or pressing operation. The aforedescribed pressing operation preferably provides relatively wide raised portions that have a surface formed to have the appearance of brick, stone, or tile elements. Preferably the raised portions have a surface formed to have the appearance of stone elements. In still other embodiments of the invention the raised portion may be decorative or formed to comprise a figure such as a date, a crest, a logo or an idiograph.

Most preferably the raised portions have a surface formed to have the appearance of a finished, quarried or sawn, stone elements. The recessed portions are formed to be relatively narrow inset areas which have a surface formed to have the appearance of recessed stone portions.

These features of a vinyl-siding corner block when used as a corner on a building are particularly useful in connection with certain types of siding, such as vinyl siding. A corner formed with the vinyl-siding corner blocks disclosed herein provides secure attachment for the vinyl siding applied to other areas of the structure and provides an overall robust and substantial appearance to the building.

Other objects and a comprehensive appreciation of the invention will become apparent from the following description given with reference to the accompanying drawings.

DETAILED DESCRIPTION OF THE INVENTION

Figure 1:
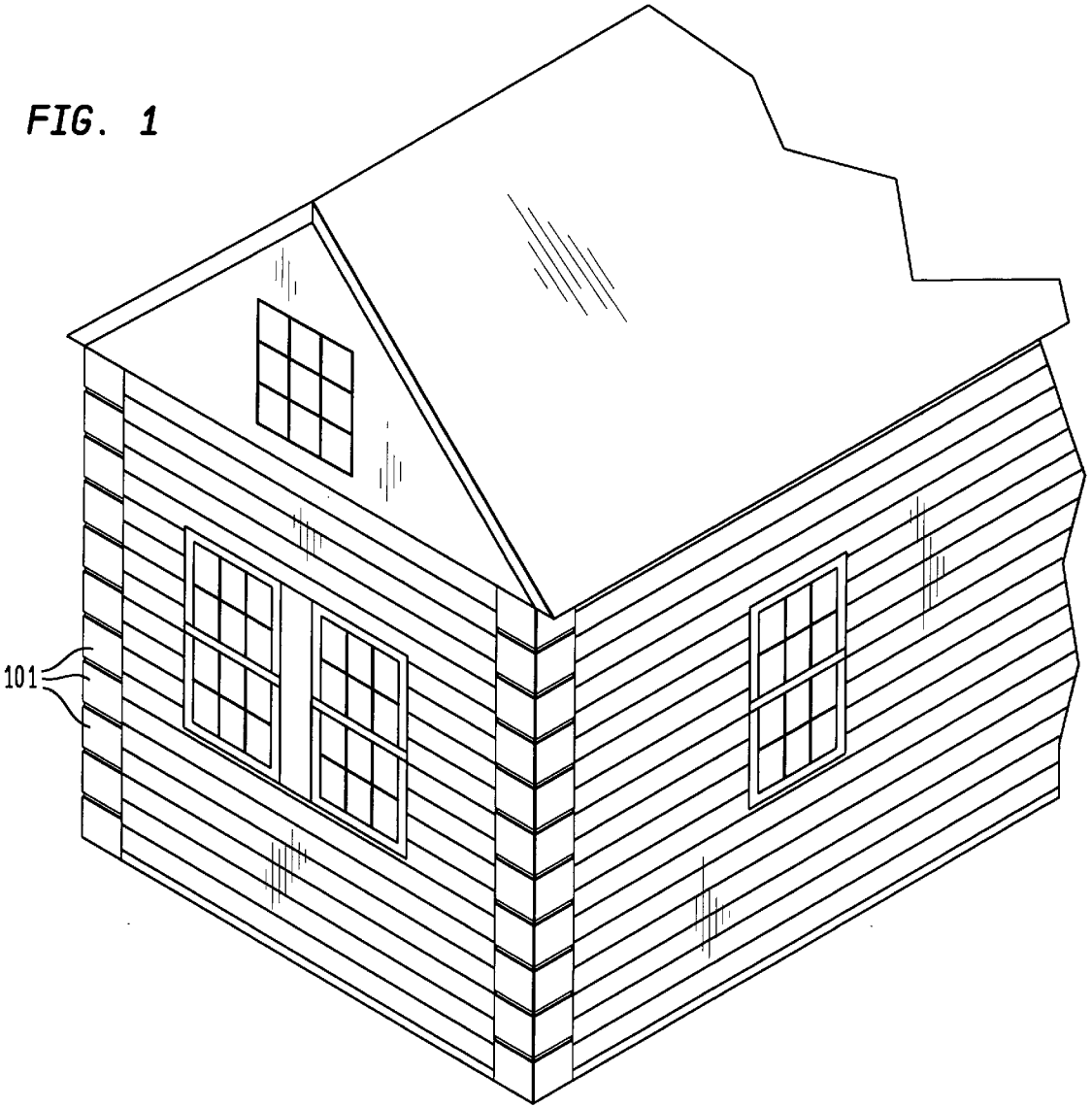
FIG. 1 is a perspective view of a building finished with the vinyl-siding corner blocks of this invention.

An appreciation of the application of the invention disclosed herein may be achieved by reference to FIG. 1. FIG. 1 shows a building upon which vinyl-siding corner blocks 101 disclosed herein are applied. FIG. 1 also shows the windows, conventional siding, roof, et cetera, of the building, that are not part of the invention disclosed herein.

Figure 2:
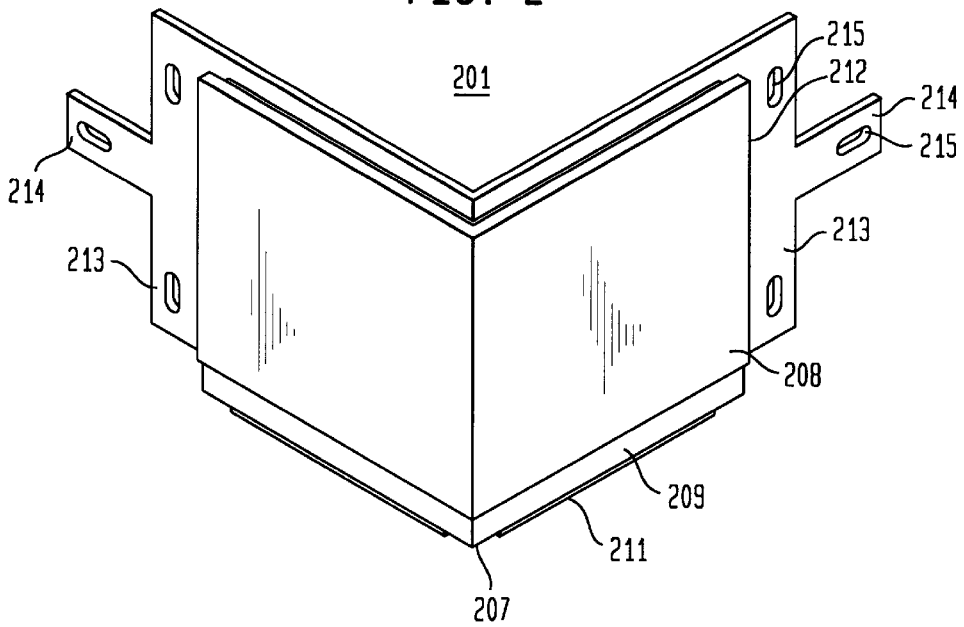
FIG. 2 is a perspective view of a vinyl-siding corner blocks of this invention.

One embodiment of the invention disclosed herein is shown in FIG. 2. FIG. 2 shows a general view of a vinyl-siding corner block 201 including a raised portion 208 thereof, a recessed portion 209, a flange 213 extended from the distal edges 212 of the vinyl-siding corner block 201 together with a tongue 214 extending therefrom. Slotted perforations 215 in the flange 213 and in the tongue 214 are shown. Also shown is a ridge 211 along lower edge 207 of the vinyl-siding corner block 201.

Figure 3:
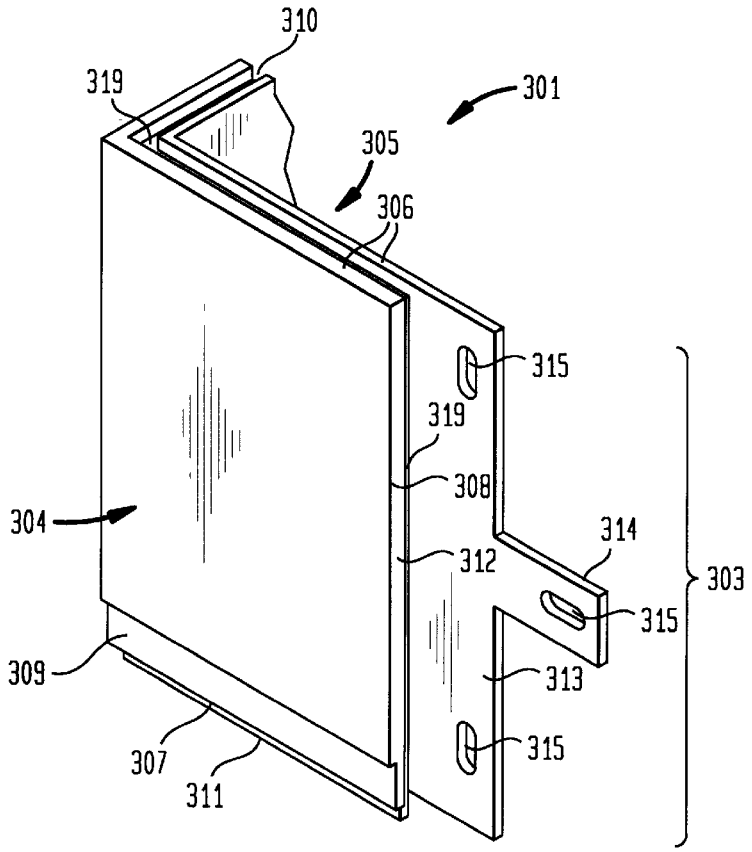
FIG. 3 is a perspective view showing a vinyl-siding corner block of this invention formed to give the appearance of multiple stone blocks.

An embodiment of the invention disclosed herein may be understood in more detail by reference to FIG. 3. FIG. 3 reveals the detailed structure of one face of a vinyl-siding corner block for application to the corners of buildings during the building of houses and the like. The vinyl-siding corner block 301 shown in FIG. 3 is fabricated as an integral vinyl sheet that is formed as an angled element. The angled element thus comprises two portions or "wings" set at an angle to one another. One wing 303 is shown in detail in FIG. 3. The wing 303 has an exterior surface 304, an interior surface 305, an upper edge 306, and a lower edge 307. The exterior surface 304 is formed to have a raised portion 308 and a recessed portion 309. The wing 303 of the vinyl-siding corner block 301 is formed with a groove 310 with a groove-base 319 in the upper edge 306, a groove 310 with a groove-base 319 in the distal edge 312, and a ridge 311 along the lower edge 307. Typically the groove is formed to be about one-half inch in depth and five-eighths inch wide and the ridge is formed to slidably fit in the groove without the application of undue force or effort.

The distal edge 312 of the vinyl-siding corner block 301 is formed with an extended flange 313. The interior surface 305 of the wing 303 of the vinyl-siding corner block 301 extends co-planar with the interior surface of the extended flange 313. The distal edge 313 is also formed to have a tongue 314 extending from it. The internal surface 305 of the vinyl-siding corner block 301 is also co-planar with the interior surface of the tongue 314. The tongue 314 extends sufficiently to permit attachment of the vinyl-siding corner block 301 to structural elements of a building, such as studs and the like. Typically, the tongue is formed to extend more than 16 inches to permit attachment of the vinyl-siding corner block to studs placed at a conventional 16 inch spacing. The flange 313 and tongue 314 of the vinyl-siding corner block shown in FIG. 3 are shown to have slotted perforations 315 for placement of fixing means used to attach the vinyl-siding corner blocks of this invention to buildings. Typically these slotted perforations are half-an-inch long and one-eighth-of-an-inch wide.

Figure 4:
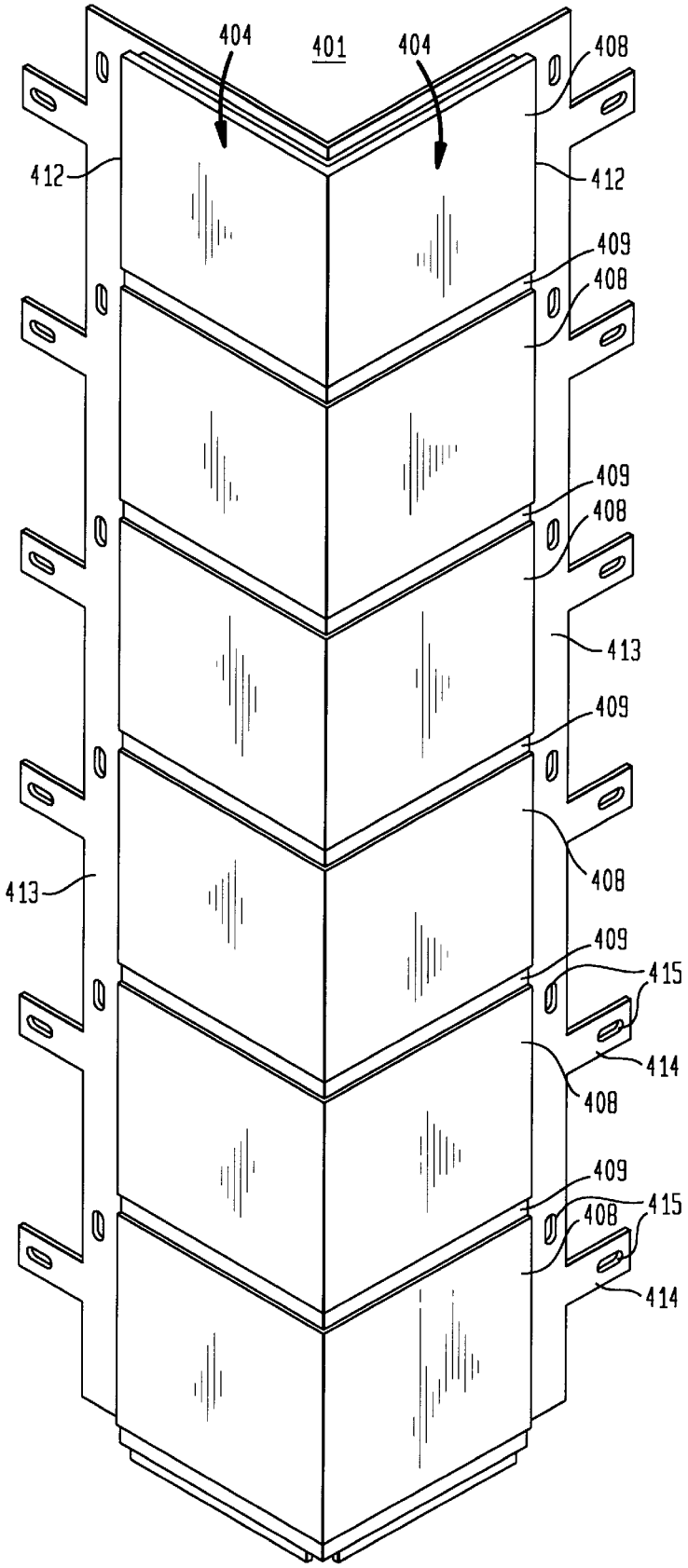
FIG. 4 is a view showing details of the form of a vinyl-siding corner block of this invention.

A further embodiment of the vinyl-siding corner block disclosed herein is shown in FIG. 4. In the embodiment of the invention shown in FIG. 4, the exterior surface 404 of the vinyl-siding corner block 401 is formed as a plurality of raised portions 408 formed to resemble stone or masonry blocks with recessed portions 409 therebetween. The recessed portions 409 are formed to resemble mortar or cement courses. Also shown in FIG. 4 are the flanges 413 and the tongues 414 extending from the distal edge 412 of the vinyl-siding corner block 401. Slotted perforations 415 in the flanges 413 and the tongues 414 are shown that are provided to be used for fixing the vinyl-siding corner block 401 to a building.

Figure 5:
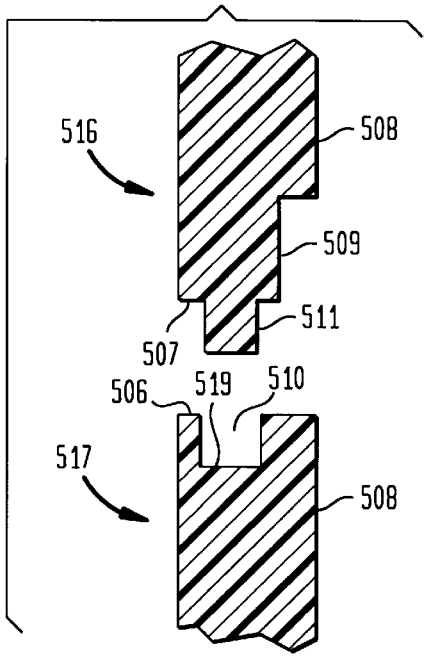
FIG. 5 is a view showing a vertical cross-section that reveals the mode of interaction of two vinyl-siding corner blocks of this invention.

FIG. 5 reveals a vertical cross section through parts of adjacent regions of an upper vinyl-siding corner block 516 and a lower vinyl-siding corner block 517 positioned as they would be immediately prior to attachment to a building. Also shown are parts of the raised portions 508 of the upper vinyl-siding corner block 516 and the lower vinyl-siding corner block 517, the recessed portion 509 of the upper vinyl-siding corner block, the ridge 511 on the lower edge 507 of the upper vinyl-siding block 516 and the groove 510 with a groove-base 519 in the upper edge 506 of the lower vinyl-siding corner block 517.

Figure 6:
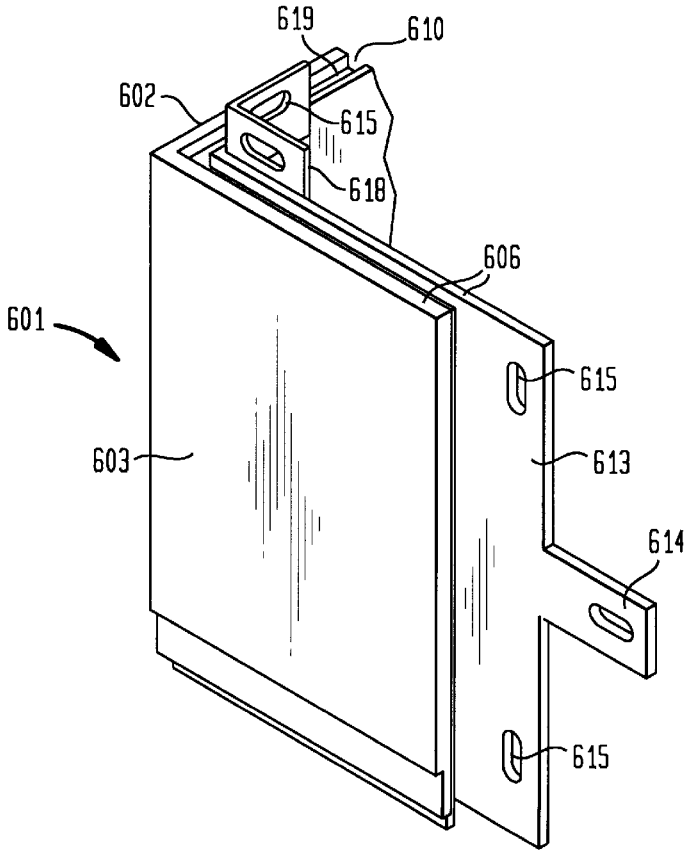
FIG. 6 is a perspective view of an embodiment of the invention formed with an L-shaped attachment flange.

A further embodiment of the invention disclosed herein is shown in FIG. 6. FIG. 6 reveals the detailed structure of one face of a vinyl-siding corner block for application to the corners of buildings during the building of houses and the like. The embodiment of the vinyl-siding corner block shown in FIG. 6 has an L-shaped flange for facilitating attachment of the corner block to a building. The vinyl-siding corner block 601 is formed from a vinyl sheet disposed to form an angled element with two wings 602 and 603 set at an angle to one another. An L-shaped attachment flange 618 is formed integrally with the vinyl-siding corner block 601. The L-shaped attachment flange 618 is positioned at the junction of two wings 602 and 603 so that it extends above the upper edge 606, with the groove 610 and a groove-base 619, of the vinyl-siding corner block 601. The flange 613, the tongue 614 and the L-shaped attachment flange 618 of the vinyl-siding corner block 601 of this embodiment of the invention are provided with slotted perforations 615 for placement of fixing means used to attach the vinyl-siding corner blocks of this invention to buildings. Typically these slotted perforations are half-an-inch long and one-eighth-of-an-inch wide.

Figure 7:
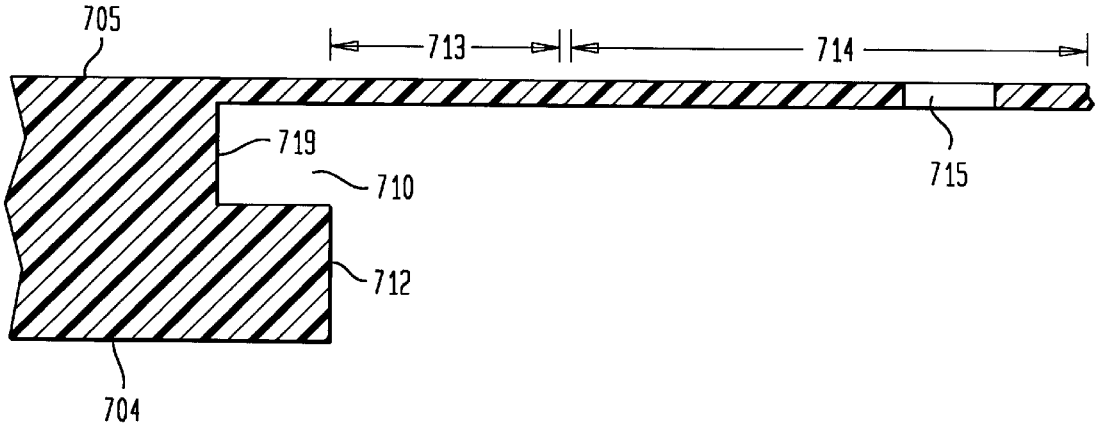
FIG. 7 is a view showing a horizontal cross-section passing through a tongue of a portion of a vinyl-siding corner block of this invention.

FIG. 7 shows a horizontal cross-section of a portion of a vinyl-siding corner block of this invention. The cross section shows the exterior surface 704, the interior surface 705, the distal edge 712 of the corner block, the groove 710 and the groove-base 719 therein. Also shown, is the flange 713 on the distal edge 712, the extension thereof that forms the tongue 714, and a section through the slotted perforation 715.

Figure 8:
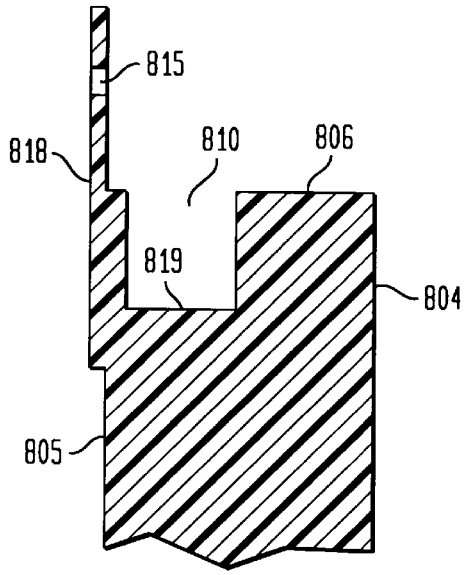
FIG. 8 is a view showing a vertical cross-section passing through the L-shaped attachment flange of a portion of a vinyl-siding corner block of this invention.

FIG. 8 is a view of a portion of an embodiment of the vinyl-siding corner block of this invention that has an L-shaped attachment flange. FIG. 8 reveals the exterior surface 804, the interior surface 805, and the integrally molded L-shaped attachment flange 818. Also shown are the upper edge 806, the groove 810 and the groove-base 819 therein, and a section through the slotted perforation 815 in the L-shaped attachment flange 818.

Figure 9:
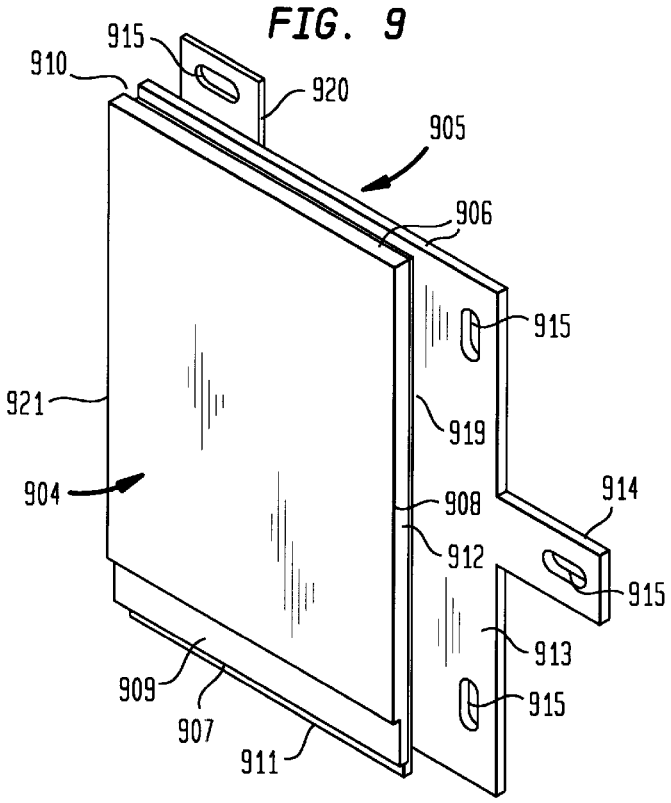
FIG. 9 is a view showing an embodiment of the invention comprising a planar vinyl-siding corner block for use on a brick-faced building.

FIG. 9 is a diagrammatic view of an embodiment of the present invention that is a planar vinyl-siding corner block for use on a brick or stone faced building. FIG. 9 shows this embodiment of the invention as a flat sheet with an exterior surface 904, and an interior surface 905. The exterior surface 904 has a raised portion 908, and a recessed portion 909. The planar vinyl-siding corner block shown in FIG. 9 has an upper edge 906, with a co-planar vertical tongue 920 extending therefrom, a lower edge 907 of the vinyl-siding corner block. The vinyl-siding corner block is formed with a groove 910 with a groove-base 919 in the upper edge 906, a distal edge 912, a lower edge 907, and a proximal edge 921. The upper edge 906 and the distal edge 912, have a groove 910 therein with a groove-base 919. The lower edge 907 has a ridge 911 thereon. The proximal edge 921 has a flat surface that is hidden from view in FIG. 9. The distal edge 912 of the vinyl-siding corner block is formed with an extended flange 913 that is co-planar with the internal surface 905 of the vinyl-siding corner block. The distal edge 912 is also formed to have a tongue 914 extending from it that is also co-planar with the internal surface 905 of the vinyl-siding corner block. The tongue 914 extends sufficiently to permit attachment of said vinyl-siding corner block to structural elements of a building, such as studs and the like. Typically, these tongue is formed to extend more than 16 inches to permit attachment of the vinyl-siding corner block to studs placed at conventional 16 inch spacing. The flange 913, the tongue 914 and the vertical tongue 920 of the vinyl-siding corner block of this embodiment of the invention are provided with slotted perforations 915 for placement of fixing means used to attach the vinyl-siding corner blocks of this invention to buildings. Typically these slotted perforations are half-an-inch long and one-eighth-of-an-inch wide.

Figure 10:
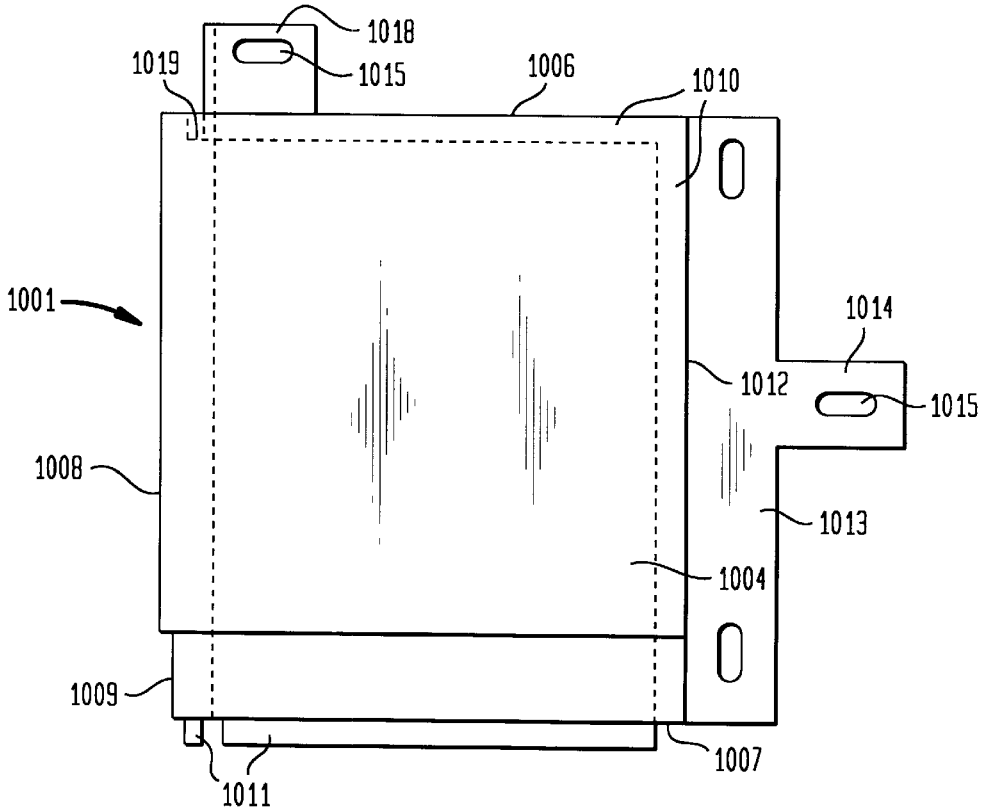
FIG. 10 is a view showing a face-on vinyl-siding corner block.

FIG. 10 is a diagrammatic representation of a face-on view of an angledelement vinyl-siding corner block embodiment of the present invention. FIG. 10 shows this embodiment of the invention with hidden features of the vinyl-siding corner block shown as dashed lines. The vinyl-siding corner block 1001 is shown as a flat sheet with an exterior surface 1004, having a raised portion 1008, and a recessed portion 1009. Also shown is the upper edge 1006 with one face of a co-planar L-shaped flange 1018 extending therefrom, and the lower edge 1007 with a ridge thereon 1011, of the vinyl-siding corner block 1001. The location of the groove 1010 of the vinyl-siding corner block 1001 is shown by dashed lines. The dashed lines indicate the position of groove 1010 with a groove-base 1019 in the upper edge 1006, and the position of groove 1010 in the distal edge 1012. The distal edges 1012 of the vinyl-siding corner block 1001 is shown with an extended flange 1013 together with tongue 1014 extending from it. The tongue 1014 extends sufficiently to permit attachment of said vinyl-siding corner block 1001 to structural elements of a building, such as studs and the like. Typically, the tongue of the vinyl-siding corner block is formed to extend 16 inches to permit attachment of the vinyl-siding corner block to studs placed at conventional 16 inch spacing. The flange 1013, the tongue 1014 and the L-shaped flange 1018 of the vinyl-siding corner block 1001 of this embodiment of the invention are provided with slotted perforations 1015 for placement of fixing means used to attach the vinyl-siding corner blocks of this invention to buildings. Typically these slotted perforations are half-an-inch long and one-eighth-of-an-inch wide.

In another embodiment of the vinyl-siding corner block disclosed herein the vinyl-siding corner block is disposed as two faces set substantially at right angles to one another and the raised portions are formed to resemble structural building materials such as brickwork, stone, wood, stucco or other materials used for surface elements of buildings. In this embodiment the recessed portions of the vinyl-siding corner block are formed to resemble a course of mortar or cement.

In yet another embodiment of the vinyl-siding corner block disclosed herein, the two portions, or wings, of the vinyl-siding corner block are set at right angles to one another. The raised portions are formed to resemble a stone or masonry block and the recessed portions are formed to resemble mortar courses.

The vinyl-siding corner blocks disclosed herein are formed, to provide relatively wide raised portions that may be surfaced to have the appearance of brick, stone, stucco or tile elements. Preferably the raised portions are surfaced to have the appearance of stone elements. Most preferably the raised portions are surfaced to have the appearance of a finished, quarried or sawn, stone elements. The recessed portions are formed to be relatively narrow inset areas which are surfaced in to have the appearance of inset stone portions or mortar joints. Most preferably the recessed portions are formed to have the appearance of inset, finished, quarried or sawn, stone elements.

The vinyl-siding corner blocks of this invention may be fabricated by any of a number of techniques known to those skilled in the art of fabricating plastic materials and the like. Preferably, vinyl-siding corner blocks of the kind disclosed herein are formed by a casting or pressing operation, Further, the invention disclosed herein provides means for securely anchoring the vinyl-siding corner blocks to the structure of a building to which blocks are applied. These means have the form of tongues with slotted perforations that serve, when affixed to the structure, to hold the corner members securely against the outer surfaces of the underlying structural elements of the building. The slotted perforations are designed to accept nails that are not to be cleated tightly against the blocks. In use, nails are to be applied substantially centrally in the slot and sufficiently firmly that the block can move laterally without warping, bending, distorting or cracking as it expands and contracts in a warming and cooling environment.

Another embodiment of the vinyl-siding corner block disclosed herein is for application to a brick-faced building. In this embodiment the vinyl-siding corner block comprises a sheet of molded material disposed as a single planar sheet or wing. The wing of this embodiment has an exterior surface and an interior surface and the exterior surface has a raised portion, a recessed portion, an upper edge, a lower edge, a proximal edge and a distal edge.

The upper edge and the distal edge of the planar vinyl-siding corner block are formed to have a groove in them that is continuous around the upper edge and the distal edge. The lower edge of the block if formed to have a ridge on it. The proximal edge of the wing is formed to be flat. As in other embodiments of this invention the distal edge has a flange and a tongue that are co-planar with the internal surface of the wing and that have in them slotted perforations for placement of fixing nails. The tongue is formed to extend sufficiently to permit attachment of the vinyl-siding corner block to structural elements of a building, such as studs and the like. The planar vinyl-siding corner block embodiment of the invention is designed to be used in conjunction with a conventional J-channel. To facilitate use of the planar vinyl-siding corner block embodiment in conjunction with a conventional J-channel the planar block is formed with a vertical tongue on the upper edge and adjacent to the proximal edge. In such use the proximal edge of the vinyl-siding corner block is positioned in the J-channel and the block is attached to the building by the vertical tongue, the flange and the tongue. The vertical tongue functions to permit attachment of the vinyl-siding corner block to the building and also acts to prevent undesirable noise caused by wind-induced vibration of the block in the J-channel.

In use, a second vinyl-siding corner block will be positioned above the first vinyl-siding corner block, with the ridge of the lower edge of the second vinyl-siding corner block interactively positioned in the groove on the upper edge of the vinyl-siding corner block. Conventional siding applied to a building in conjunction with a planar vinyl-siding corner block is interactively positioned in the groove in the distal edge.

The vinyl-siding corner block of the present invention is designed so that conventional siding applied to the building can be interactively positioned in the grooves in the sides, or distal edges, of the angled elements as it is applied to the building.

The vinyl-siding corner blocks disclosed herein are especially adapted for use in connection with vinyl siding in other ways. The grooved upper edge of a vinyl-siding corner block is designed to be used to advantage in connection with the application of siding sections to a building having an A-frame style roof. In such a use the siding section used to fill the "A" region of the side wall of the building may be cut to slide into, and fit within, the groove in the upper edge of the vinyl-siding corner block. When used at the corners of a building having a Mansard style roof, the vinyl-siding corner blocks are applied to abut to the sofit board.

Multiple vinyl-siding corner blocks of the type disclosed herein may be applied to the corner of a building by attaching a first vinyl-siding corner block at the bottom of a corner of the building. This first vinyl-siding corner block is attached to the building by passing fixing means through the slotted perforations in its tongues. This first vinyl-siding corner block may also be attached by means of its L-shaped flange if such an embodiment of the invention is being used.

A second vinyl-siding corner block is then positioned above the first, with the ridge of the lower edge of the angled element of the second vinyl-siding corner block interactively positioned with the groove of the upper edge of the angled element of the first vinyl-siding corner block. The second vinyl-siding corner block is then attached to the building by its tongues, and its L-shaped flange if such an embodiment is used.

Third and subsequent vinyl-siding corner blocks are then attached to the building in a similar manner.

The features of a vinyl-siding corner block as disclosed herein are particularly useful and attractive when the vinyl-siding corner block applied to a building. A corner formed with the vinyl-siding corner blocks disclosed herein provides secure attachment for vinyl siding that may be applied to other areas of the structure and provides an overall robust and substantial appearance to the building.

It is claimed:

1. A vinyl-siding corner block comprising an angled element for use in the building of houses, said angled element comprising:

a sheet of material, said sheet being disposed as a first wing and a second wing, said wings being set at an angle to one another;

said wings each having an exterior surface and an interior surface, said exterior surface having a raised portion and a recessed portion, said sheet having an upper edge, a lower edge, and two distal edges, said upper edge and said distal edges having a groove therein, said groove being continuous around said upper edge and said distal edges, said lower edge having a ridge thereon, said distal edges having flanges thereon, said flanges being co-planar with said internal surface, said distal edges having tongues extended therefrom, said tongues being co-planar with said internal surface and extending sufficiently so as to permit attachment of said vinyl-siding corner block to structural elements of a building, by means of said tongues, said flanges and said tongues being provided with slotted perforations through which attachment means may be passed when attaching said vinyl-siding corner block to a building, said wings having an integrally formed L-shaped attachment flange positioned at a junction of said wings and extending from said upper edge of said vinyl-siding corner block, whereby a first vinyl-siding corner block can be attached to a building by said flanges and said tongues, second, and subsequent, vinyl-siding corner blocks can be positioned above said first vinyl-siding corner block, said ridge of said lower edge of each subsequent vinyl-siding corner block being interactively positioned in said groove of said upper edge of a previously applied vinyl-siding corner block, said second, and subsequent vinyl-siding corner blocks are attached to a building by said flanges or said tongues, and conventional siding applied to said building is interactively positionable in said grooves in said distal edges.

2. The vinyl-siding corner block of claim 1 wherein:

said sheet of material is a sheet of polyvinyl chloride;

said sheet of material is disposed as two wings set substantially at right angles to one another;

said raised portion is formed to resemble a structural building material used for surface elements of buildings; and said recessed portion is formed to resemble a recessed stone surface, a course of mortar or cement.

3. The vinyl-siding corner block of claim 1 wherein:

said sheet of material is disposed as two wings set at right angles to one another;

said raised portion is formed to resemble a stone or masonry block; and said recessed portion is formed to resemble a recessed stone surface.

4. A vinyl-siding corner block comprising an angled element for use in the building of houses, said angled element comprising:

a sheet of material having an internal surface, said sheet being disposed as a first wing and a second wing, said wings being set at an angle to one another;

said sheet having an upper edge and two distal edges, said upper edge and said distal edges having a groove therein, said groove being continuous around said upper edge and said distal edges, said sheet having a lower edge with a ridge thereon, said distal edges having flanges thereon, said flanges being co-planar with said internal surface, said distal edges having tongues extended therefrom, said tongues extending sufficiently so as to permit attachment of the vinyl-siding corner block to structural elements of a building, by means of said tongues, said flanges and said tongues being co-planar with said internal surface and being perforated for passage of attachment means when attaching the vinyl-siding corner block to a building, wherein external surfaces of said wings are formed as a plurality of raised portions that resemble stone or masonry blocks with recessed portions therebetween formed to resemble recessed stone surfaces.

5. A method to apply vinyl-siding corner blocks and conventional vinyl siding to a building, said method comprising:

(i) measuring a building to which said vinyl-siding corner blocks are to be applied, thereby determining a measured height of a corner of said building;

(ii) subtracting from said measured height of said building a whole-number multiple of a height of a single block to be applied, thereby obtaining a remainder that is less than said height of a single block;

(iii) cutting a vinyl-siding corner block at a location so as to produce a portion of a vinyl-siding corner block with a dimension equal to said remainder, wherein said dimension is measured from the top of said block to said location of said cutting;

(iv) positioning said portion of a vinyl-siding corner block at a lowest position of said corner of said building;

(v) attaching said portion of a vinyl-siding corner block to said building by passing attachment means through perforations in said portion;

(vi) positioning a whole vinyl-siding corner block above said portion so as to interactively position a ridge on the lower edge of said whole vinyl-siding corner block in a groove on the upper edge of said previously applied portion;

(vii) attaching said whole vinyl-siding corner block to said building by passing attachment means through perforations in said vinyl-siding corner block;

(viii) positioning successive vinyl-siding corner blocks at said corner of said building so as to interactively position a ridge on the lower edge of each successive vinyl-siding corner block in a groove on the upper edge of each immediate previously applied vinyl-siding corner block;

(ix) attaching each of said vinyl-siding corner blocks to said building by passing attachment means through perforations in said vinyl-siding corner blocks;

(x) positioning conventional siding interactively in grooves in distal edges of said vinyl-siding corner blocks;

(xi) attaching said conventional siding to said building by conventional means.

6. The method of claim 5, wherein steps (v), (vii) and (ix) comprise:

passing attachment means through perforations in flanges and tongues of said portion and said of vinyl-siding corner blocks.

* * * * *